US006638703B2

(12) United States Patent
Jezequel et al.

(10) Patent No.: US 6,638,703 B2
(45) Date of Patent: Oct. 28, 2003

(54) METHOD FOR PREPARING SILVER HALIDE PHOTOGRAPHIC TABULAR GRAINS EMULSIONS

(75) Inventors: Pierre-Henri Jezequel, Givry (FR); Bruno C. Barillon, Chalon sur Saone (FR); Christian S. Schmuckle, Chalon sur Saone (FR)

(73) Assignee: Eastman Kodak Company, Rochester, NY (US)

( * ) Notice: Subject to any disclaimer, the term of this patent is extended or adjusted under 35 U.S.C. 154(b) by 53 days.

(21) Appl. No.: 10/053,374

(22) Filed: Nov. 9, 2001

(65) Prior Publication Data

US 2002/0068249 A1 Jun. 6, 2002

(30) Foreign Application Priority Data

Nov. 14, 2000 (FR) ..... 00 14576

(51) Int. Cl.[7] ..... G03C 1/005; G03C 1/494
(52) U.S. Cl. ..... 430/569; 430/567
(58) Field of Search ..... 430/567, 569

(56) References Cited

U.S. PATENT DOCUMENTS

| | | | | |
|---|---|---|---|---|
| 5,202,226 A | | 4/1993 | Saitou | |
| 5,215,879 A | | 6/1993 | Suzuki et al. | |
| 5,252,453 A | | 10/1993 | Tsaur et al. | |
| 5,254,454 A | * | 10/1993 | Mimiya et al. | 430/569 |
| 5,318,888 A | * | 6/1994 | Weberg et al. | 430/569 |
| 5,378,600 A | * | 1/1995 | Goan | 430/569 |
| 5,712,083 A | * | 1/1998 | Hosoya et al. | 430/567 |
| 5,888,718 A | * | 3/1999 | Maskasky et al. | 430/569 |

FOREIGN PATENT DOCUMENTS

| | | |
|---|---|---|
| EP | 0 639 793 | 2/1995 |

* cited by examiner

*Primary Examiner*—Geraldine Letscher
(74) *Attorney, Agent, or Firm*—Andrew J. Anderson

(57) ABSTRACT

The invention relates to a method for preparing photographic silver halide tabular grains emulsions. The method of the invention comprises a first single nucleation step wherein stable tabular seeds of silver halide are formed, and a second step wherein different batches of seeds obtained in the first step are grown to yield identical or different emulsions. This combination of steps represent a robust process for preparing tabular grain emulsions at different scales.

17 Claims, No Drawings

METHOD FOR PREPARING SILVER HALIDE PHOTOGRAPHIC TABULAR GRAINS EMULSIONS

FIELD OF THE INVENTION

This invention relates to the preparation of photographic emulsions containing silver halide tabular grains.

BACKGROUND OF THE INVENTION

The preparation of silver halide grains generally includes a nucleation step and at least one crystal growth step.

In this patent application, the term "nuclei" designates grains of small size (less than 0.1 micrometer, for example) obtained in the nucleation step. The term "seeds" designates the grains obtained after the nuclei have been submitted to a first growth step. These seeds, generally smaller than 0.4 micrometer, are then subjected to a second growth step to obtain the final silver halide grains.

There are various conventional processes for achieving the nucleation step of silver halide grains. In single-jet processes, an aqueous solution of a silver salt is introduced into a stirred reactor containing a colloid, generally gelatin, and an aqueous solution of halides. In double-jet processes, the silver salt and halide solutions are introduced either simultaneously or alternately from two separate sources in a stirred reactor containing the colloid. In both cases, the growth step typically follows immediately and is achieved by double-jet precipitation.

In these conventional processes it can be difficult to correlate the number of nuclei formed during the nucleation with the final number of grains, in particular because of Ostwald ripening, which causes the less soluble larger grains to grow at the expense of the more soluble small ones. For a given number of nuclei initially formed, the number of grains remaining after the growth step will thus generally be lower than the number of nuclei.

There exists a third type of process that involves carrying out a nucleation step in a first reactor by simultaneously introducing solutions of silver salts, halides and colloid, and then a growth step in a second reactor containing the nuclei formed in the first reactor and where a solution of a silver salt and one or more halide solutions are introduced.

U.S. Pat No. 5,254,454 describes a process for preparing silver halide grains for photographic emulsions in which the nucleation step is carried out in a vigorously stirred mixer (10,000 revolutions per minute) into which a solution of silver salt, a solution of halides, and a solution of colloid are introduced. According to U.S. Pat. No. 5,254,454, a first emulsion is thereby formed containing fine silver halide grains (size less than or equal to 0.01 micrometer). This first emulsion is then transferred to a reactor in which the pAg is modified. The modified emulsion is then transferred to a second reactor containing a second emulsion made up of small sized silver halide crystals. The crystals that are present in the second reactor, after dissolution, allow the growth of the fine grains in the first emulsion.

Another process involves separating the nucleation and growth operations temporally and spatially. In a first reactor a seed solution, which is stored temporarily, is generated by precipitation of silver salts and halide salts in the presence of a colloidal agent. A part of this seed solution is subsequently used to seed a second reactor initially containing a colloidal agent and halide salts. The final growth of these seeds is then achieved by a conventional double-jet method.

In some cases this process can afford silver halide emulsions that display special properties, such as reduced pressure sensitivity. This process has been described for tabular grains. However, none of the publications that describe the use of this process for tabular grains provides for any improvement of the characteristics of the industrial production of the grains over any of the conventional processes. The processes using tabular grains do not, according to the descriptions that are provided, afford any reduction in the variability observed in the operations performed for the industrial production of tabular crystals.

U.S. Pat. No. 5,712,083 uses the general idea of tabular seeds and describes an intermediate washing step to remove the growth modifying agent used in the operation that served to generate the seeds. It does not, however, describe any intermediate adjustment and therefore does not aim to improve the overall reproducibility of the precipitation processes.

U.S. Pat. No. 5,378,600 also describes the tabular seed approach, similarly with no intermediate adjustment. The size of the seed crystals is relatively small (0.3 micrometer), but their thickness is high (at best 0.1 micrometer), which is relatively easy to achieve, whereas it is difficult to produce small thin crystals in sufficient amounts. In addition, these seeds are used for the final growth operation at concentrations greater than 0.5% of the volume of the initial solution present in the growth reactor. This value is high, and so does not necessarily favor obtaining high industrial yields. With smaller seeds such as those generated in this invention, smaller quantities can be added, in all cases less than 0.5% by volume.

In view of the wide range of silver halide photographic emulsions used in photographic products, it is most desirable to have a method for the preparation of emulsions that are either identical or different as regards the size of their silver halide grains or the size range of their grains, from one single nucleation step, irrespective of whether the precipitations are carried out at the laboratory, pilot or production scale. It is known that nucleation is a precipitation step that induces wide variability in the final crystal size. An identical but well controlled nucleation for all crystals could therefore reduce that variability, while making it easier to make emulsions that are identical at all scales.

Furthermore, in tabular grain emulsions there is often an appreciable proportion of grains that are unwanted because they have not the required shape, diameter or thickness specifications. In addition, the dispersity of the grain characteristics is an important parameter for ensuring that the grains respond to light excitation and to image forming development in as even a manner as possible. To overcome these problems seed emulsions can be prepared from which the final tabular grains, as indicated above, can be obtained by growing. However, if the population of these grains is not sufficiently monodisperse and homogeneous, or not sufficiently stable, it is unlikely that the final emulsion will display the characteristics that are wanted. Because of this difficulty it is not possible at will to obtain emulsions with a high morphological purity after growth from an initial population of nuclei. By high morphological purity is meant an emulsion in which the tabular grains account for at least 50% and advantageously more than 80% and even more than 90% of the total surface area of the grains. By "tabular grain" is meant grains whose aspect ratio (equivalent circular diameter: thickness) is at least equal to 2, preferably greater than 3 and is advantageously greater than 8.

SUMMARY OF THE INVENTION

This invention solves the problems stated above and relates to a method to produce a quantity of thin tabular grains, substantially monodisperse, and of high morphological purity, from a controlled stable seed emulsion. A further object of this invention is a method for preparing different emulsions or several batches of silver halide tabular grains emulsion from a single controlled stabilized seed emulsion.

The method of this invention, for preparing a silver halide tabular grain emulsion, comprises the following steps:

(a) A batch of nuclei emulsion is prepared in a nucleation reactor in the presence of a peptizing agent of the hydrophilic colloid type, and these nuclei are then submitted to a physical or Ostwald ripening.

(b) The nuclei obtained in step (a) are grown into stable tabular seeds, keeping the ratio of initial volume of nucleation medium to final volume of medium after growth of nuclei in the nucleation reactor between 0.4 and 0.95.

(c) A portion of the batch of seed emulsion obtained in step (b) is taken.

(d) The portion of seed emulsion taken in step (c) is submitted to a growth step.

According to one embodiment, the method of the invention comprises the following steps:

(a) A batch of nuclei emulsion is prepared in a nucleation reactor in the presence of a peptizing agent of the hydrophilic colloid type, such as gelatin, and these nuclei are then physically ripened (Ostwald ripening).

(b) The nuclei obtained in step (a) are grown to obtain $M_b$ moles of tabular seeds with an average grain volume $V_s$, keeping the ratio of initial volume of nucleation medium to final volume of medium after growth of nuclei in the nucleation reactor between 0.4 and 0.95 and preferably between 0.7 and 0.9.

(c) Mg moles of the batch obtained in step (b) are taken.

(d) The $M_s$ moles taken are further grown in a growth reactor to obtain $M_f$ moles of tabular emulsion with an average grain volume after growth of $V_f$.

(e) Steps (c) and (d) are repeated $N_b$ times to submit a total quantity of $M_b$ moles of seeds to growth, where $M_s$ is substantially equal to $$M_f \times (V_s : V_f)$$

$N_b$ is substantially equal to $M_b$: $M_s$.

The term "substantially" means that, in addition to the standard accuracy of measurements some nuclei or seeds may dissolve so that the balance of chemical species may be biased.

Steps (a) and (b) of the method of the invention provide nuclei, and then stable tabular seeds that are used to generate tabular grains. The usual aim is to obtain seeds using less than 5% of the total silver to be used for the final emulsion.

The stable seed emulsion is obtained in the nucleation reactor by a conventional series of steps comprising a double-jet precipitation and physical ripening, followed by growth. The nucleation reactor initially contains an aqueous solution of a peptizing agent that can be supplemented with usual constituents, i.e., salts, for example a small amount of alkali metal halide, an anti-foaming agent, or a growth modifying agent. According to one embodiment, to reduce the dispersion of the crystals formed, a polyalkylene oxide block copolymer surfactant is used, containing two lipophilic alkylene oxide end sequences linked by a hydrophilic alkylene oxide sequence representing at least 4% of the molecular weight of the block copolymer. These compounds are well known and have many applications as non-ionic surfactants. See for example I. R. Schmolka, "A Review of Block Polymer Surfactants" J. Am. Oil Chem. Soc. Vol 54 No 3, 1977, pages 110–116, or A. S. Davidsohn and B. M. Milwidsky, "Synthetic Detergents" John Wiley & Sons, N.Y., 1997, pages 29–40. These block copolymers have been found to be useful when they are introduced into the reactor in the form of a solution or as aqueous dispersions, with strong stirring. Small quantities of these block copolymers, corresponding for example to concentrations as low as 0.1% by weight based silver, are sufficient. A preferred concentration is as low as about 1% based on silver. Larger quantities of copolymer can be used, including in subsequent steps of the emulsion producing process. Preferably, the block alkylene oxide copolymer has the formula:

LAO1-HAO1-LAO1 where LAO1 represents a lipophilic alkylene oxide end sequence and HAO1 represents a hydrophilic alkylene oxide middle sequence. The sequence HAO1 can account for 4 to 96% by weight of the total weight of the copolymer, and the molecular weight of the copolymer is preferably in the range 760–16,000. The vAg is roughly between −20 and +50 mV and the temperature is between 20 and 50° C. The reactor is fitted with a stirrer. At the start of the precipitation the vAg is adjusted preferably to a value between −20 and +20 mV. The pH of the dispersion medium is adjusted to a value between 1.5 and 6.0, and preferably between 1.8 and 3. To adjust the pH at this range of values, a strong mineral acid such as nitric acid can be used.

The dispersion medium for the nucleation comprises a peptizing agent that is a hydrophilic colloid such as gelatin, modified gelatin, for example phthalated gelatin, or oxidized gelatin, i.e., gelatin that contains less than 30 micromoles of methionine per gram. Such hydrophilic colloids are described in Research Disclosure, September 1994, n° 36544, part IIA. Low molecular weight gelatin avoids high viscosities. Oxidized gelatin is obtained from ordinary gelatin that is treated with a strong oxidizer, as described in U.S. Pat. No. 4,713,323 (Maskasky) and U.S. Pat. No. 4,942,120 (King). When oxidized gelatin is used as a peptizing agent it is preferable to adjust the pH to a value below 5, and even a value lower than 3, for example between 1.5 and 2.0. The quantity of hydrophilic colloid represents 20 to 800 (and preferably 40 to 600) grams per mole of silver introduced during the nucleation. This quantity of hydrophilic colloid helps stabilize the seeds formed.

According to one embodiment, the gelatin (or colloid in general), can be mixed with an alkali metal halide in the reactor. The reactor is generally maintained at a temperature below 50° C., and preferably below 40° C.

The precipitation is carried out using a double-jet method. A jet of halides is used, for example a jet of halides made up of potassium or sodium bromide and possibly a jet of another water-soluble alkali metal halide. The concentration of the halide solutions can be between 1 M and 5.5 M, preferably between 3 M and 5 M. A jet of soluble silver salt is also used, generally silver nitrate with a molar concentration close to that of the halide jet. The jet flow rates are between 0.2 and 10 ml/minute/liter, and preferably between 1 and 5 ml/minute/liter of filled reactor volume. The medium is stirred, preferably with a turbine device of the type described in Research Disclosure No 38213, February 1996, pages 111–114.

During the precipitation of the seeds, the nuclei are physically ripened (Ostwald ripening). This operation can be carried out in the presence of a ripening agent. The ripening agents that can be used are described in Research Disclosure, Publication n° 36544, September 1994, page 505. One particularly advantageous ripening agent is ethanolamine, described in U.S. Pat. Nos. 5,246,826 and 5,246,827. The nuclei then are submitted to go a conventional growth step that can be carried out in the same reactor. After his growth step, seeds are obtained that ultimately possess in general an equivalent circular diameter (ECD) smaller than 0.5 microns, and a thickness of less than about 0.06 microns. The diameter of the seeds is measured by the electric field birefringence (EFB) method, as described in the proceedings of the PARTEC 98 congress, $7^{th}$ European Symposium on Particle Characterization, Nuremberg, Germany, 1998, page 23, the thickness being measured using an interferometric method such as the measurement of the reflectance of a coated emulsion (CRT).

The seeds obtained are stable and can be stored in the usual conditions of storage of photographic emulsions. Being able to store the seed emulsion is an important characteristic because most of the earlier processes used provide seeds of sufficient stability that require a growth step to be performed immediately after the nucleation step.

Once the seeds are obtained, they can be grown in the conventional way to obtain the desired final grain size. The halides introduced during this "final growth" step can be chosen irrespective of the halides chosen for the nucleation. According to this invention, a certain quantity of seeds prepared as indicated above is taken to carry out a growth step yielding $M_f$ moles of final tabular grains. This corresponds to a number of grains that can be defined by:

$$n=M_f\times(V_M:V_f)$$

where $V_M$ is the molar volume of the silver halide and $V_f$ is the average volume of the grains after growth. As n is constant after a growth step, n also represents the number of seeds involved in the final growth step and so can also be expressed by:

$$n=M_s\times(V_M:V_s)$$

where $M_s$ is the number of moles of seeds involved in each final growth step, $V_M$ is the molar volume of the silver halide and $V_s$ is the average volume of the seeds.

Hence the number of moles of seeds to be provided for a final growth step is $$M_s=M_f\times(V_s:V_f)$$

$M_s$ depends therefore on the volume of the seeds. By measuring the seed concentration, it is therefore possible to determine the mass of seeds that has to be taken for each final growth step, according to the final characteristics wanted and especially according to the grain size required after growth. The concentration of the seeds can also be adjusted according to the number of moles $M_s$ of seeds to be taken for a final growth operation. For example, after step (a) of the process defined above the concentration of the seed emulsion can be adjusted once or several times by adding a peptizing agent to the emulsion, for example gelatin in aqueous solution, so that the numerical concentration of seeds in the seed emulsion can be kept at a preset value, for example between $0.5\times10^{15}$ and $10\times10^{15}$, and advantageously between $1.0\times10^{15}$ and $5\times10^{15}$ grains per kg of emulsion.

It is particularly advantageous to be able to split the seeds obtained in step (b) into several batches and to carry out a specific final growth step on each one. In this way a range of several different emulsions can be obtained from a single preparation. If the stabilized seeds are split into several batches each containing a set number of seeds, and if each of these batches subsequently undergoes a specific final growth step, then emulsions that differ in average size and (or) composition and (or) size dispersion can be obtained after growth of one same seed preparation. For example, with a single intermediate seed preparation it is possible to prepare all the emulsions necessary for the manufacture of a photographic product comprising several layers of photographic emulsions each one having its own specific speed. In this way a single seed emulsion can be used to manufacture color photographic products, which conventionally comprise at least one layer of red light sensitive emulsion, at least one layer of green light sensitive emulsion, and at least one layer of blue light sensitive emulsion.

The method of this invention exhibits a reproducibility and a robustness that are improved relative to other existing processes, as it is well known that the most delicate step for obtaining grains of a particular morphology is the nucleation step. It also makes high productivity possible, as the method can be used to produce at least 0.6 moles of silver halide per liter of emulsion per operation.

Although ideally it is desirable to use the same seeds for most of the emulsions, this method finally allows greater flexibility insofar as seeds with set characteristics can be readily prepared, and by choosing an appropriate quantity of seeds of a given preparation, the size of the grains obtained after growth can be easily controlled.

In addition to the specific aspects of the method according to the invention, the preparation of the emulsions can include conventional operations such as those described in Research Disclosure, Publication n° 36544, September 1994, page 501, Chapters I, II and III. The emulsions can be chemically or spectrally sensitized as described in Research Disclosure, cited above, Chapters IV and V. The emulsions can contain conventional additives such as anti-UV agents, optical brighteners, anti-fogging agents, stabilizers, light absorbing or reflecting agents, or agents mentioned in Research Disclosure, cited above, chapters VI, VII and VII. The emulsions can also contain agents that modify the physical properties of coatings or that facilitate the formation of coatings such as those described in Research Disclosure above, Chapter IX.

EXAMPLE 1

Preparation of Seeds

The following solutions were prepared:

Solution Ag/A: 1,273 ml of a 3.8 mole/liter aqueous solution of silver nitrate.

Solution X/A: 1,511 ml of a 3.8 mole/liter aqueous solution of sodium bromide.

Solution Ag/B: 66 ml of a 3.5 mole/liter aqueous solution of silver nitrate.

Into a nucleation reactor of capacity 20 liters were put, with stirring, 13.54 liters of distilled water, 27.4 g of oxidized gelatin, and 0.9 ml of a solution of Pluronic-31R1™ (block copolymer of ethylene oxide and propylene oxide). The temperature of the mixture was raised to 40° C. The pAg was adjusted to 9.6 with sodium bromide. After 10 minutes the mixture was cooled to 30° C. and the pH adjusted to 1.85 with $HNO_3$.

The solution Ag/B was added simultaneously at a rate of 79.2 ml/minute with part of the solution X/A at a rate of 73 ml/minute. The jets of nitrate and bromide were stopped after 50 seconds. After stirring for 30 seconds more of the solution X/A was added at a rate of 37 ml/min for 24 seconds. After waiting for 90 seconds the temperature was raised to 48° C. in 10 minutes. Two minutes before reaching the temperature of 48° C. 9 g of ethanolamine was added. When the temperature of 48° C. was reached the pH was adjusted to 9.75 with sodium hydroxide. These conditions were maintained for 9 minutes, after which time 1,250 ml of a 120 g/l aqueous solution of gelatin was added, additionally containing 0.26 g of anti-foaming agent (polyethylene glycol dioleate, Emerest marketed by Henkel). The pH was then adjusted to 5.70 with nitric acid. The mixture was cooled to 37° C. in 4 minutes. In 10 minutes, solution Ag/A was added at a rate of 9.5 ml/min simultaneously with solution X/A at a flow rate such as to keep the pAg at 9.75. The flow rate of the solution Ag/A was then raised from 9.5 to 36.1 ml/min in 32 minutes. The pAg was maintained at 9.75 by adding solution X/A. Finally the flow rate of the solution Ag/A was raised from 36.1 to 63.6 ml/min in 9 minutes while maintaining the pAg at 9.75 by addition of solution X/A.

A total of 5.07 moles of tabular seeds of silver bromide was prepared, presenting an ECD of about 0.39 microns and a thickness of about 50 nm. The equivalent circular diameter (ECD) was measured by EFB. The average volume ($V_s$) of these seeds was close to $5\times10^{-21}$ $m^3$.

Soluble salts were eliminated by ultrafiltration while simultaneously adding distilled water until the conductivity of the filtrate fell below 2 mS/cm. Oxidized gelatin was added to obtain a concentration of 55 g of gelatin per mole of silver bromide. The value of ECD measured by EFB served to calculate the real average volume ($V_s$) of the seeds, which can fluctuate slightly from one precipitation to another. According to the calculated $V_s$, the concentration of the emulsion was adjusted by adding water to obtain a number of grains per kg equal to $2.749\times10^{15}$. The emulsion was set and stored at a temperature of +4° C.

This seed preparation operation was repeated five times, yielding five batches of seed emulsion all with the same concentration of grains per kg.

EXAMPLE 2

Final Growth of Seeds

The objective was to produce, for one growth operation, 11.4 moles ($M_f$) of tabular grains with a volume $V_f$ of $0.299\times10^{-18}$ $m^3$ (ECD=2 microns and thickness=0.095 microns). The number of grains involved in each operation was $$n=(M_f \cdot V_M)/V_f$$

where $V_M$ (molar volume of AgBr) is $29\times10^6$ $m^3$.

This number of grains n was thus here $1.13\times10^{15}$.

Because the batches of seed emulsion prepared as described in Example 1 were adjusted to $2.749\times10^{15}$ grains per kg, the weight of seed emulsion involved in each growth operation was $1.13\times10^{15}$:$2.749\times10^{15}$, i.e., 0.411 kg. According to the slight variation in the average diameter of the seeds, this 411 g represented a number of moles of AgBr fluctuating about 0.19.

In a 20-liter reactor a solution of 150 g of oxidized gelatin in 4 liters of distilled water was added with stirring. The contents of the reactor were heated to 50° C. In 5 minutes 411 g ($M_s$=0.19 moles, $P_s$:0.411 kg) of the seed emulsion prepared in Example 1 was added. The pAg was adjusted to 9.3 with NaBr and the pH to 4.5 with nitric acid.

The growth was achieved by simultaneously adding, in 110 minutes, 6,177 ml of a 2 moles/liter solution of silver nitrate and 6,177 ml of a 2 moles/liter solution of sodium bromide with a flow rate of silver nitrate increasing from 7 to 95.1 ml/minute. During this growth step the sodium bromide flow rate was adjusted to maintain the pAg at 9.3. After this growth step, the temperature was rapidly lowered from 50° C. to 38° C. The soluble salts were eliminated, and the emulsion was set and then stored at +4° C. In this way $M_f$=11.4 moles of tabular grain silver bromide emulsion was prepared that displayed the following characteristics:

ECD: 2 microns (measured by EFB).

Thickness: 0.095 microns (95 nm).

Average volume: $V_f=0.3\times10^{-18}$ $m^3$.

From each batch of seeds prepared in Example 1, 26 portions of 411 g (about 0.19 moles) of seeds can be taken, each of which can be caused to grow, thereby yielding 26 batches of tabular grain emulsion as above. Thus in all about 26×0.19=4.94 moles of seed emulsion are used per batch. Given that five batches are available (prepared as indicated in Example 1), this series of 26 growth operations can be repeated five times, the weight of seeds to be used in each growth operation being constant and equal to 411 g.

EXAMPLE 3

The objective was to produce, for one growth operation, 11.4 moles ($M_f$) of tabular grains with a volume $V_f$ of $0.191\times10^{-18}$ $m^3$ (ECD=1.44 microns and thickness=0.117 microns). These grains, which differ in size from those sought in Example 2, were obtained from seeds prepared as described in Example 1.

In a 20-liter reactor was placed 150 g of oxidized gelatin dissolved in 3.71 liters of distilled water, followed by 0.9 g of pluronic acid. The mixture was heated to 44° C. In 5 minutes was added to the reactor PS=643 g (equivalent to $M_s$=about 0.30 moles) of seeds prepared according to the procedure of Example 1. The pAg was adjusted to 9.4 with NaBr and the pH to 4.5 with $HNO_3$.

The seed growth was started by simultaneously adding 6,050 ml of a 2 moles/l aqueous silver nitrate solution and 6,171 ml of a 2 moles/i aqueous sodium bromide solution in 110 minutes at a flow rate increasing from 7 ml/minute to 93 ml/minute. The NaBr flow rate was adjusted to maintain the pAg at 9.4.

When this addition was completed the temperature was lowered from 44 to 38° C. Soluble salts were then eliminated, the mixture was concentrated, and the emulsion gelled by cooling for subsequent storage.

In this way $M_f$=11.3 moles of a monodisperse emulsion of tabular grains of silver bromide was prepared with an average ECD of 1.44 microns and an average thickness of 0.117 microns.

This procedure can be repeated 16 times from a batch of seeds prepared as described in Example 1. This series of 16 batches can be repeated as many times as there are batches of seeds, to yield the required emulsions. This is due to the great robustness of the seed preparation step according to the invention, which affords a very homogeneous population obtained within a given batch, and even from one batch to another, owing to the method of adjustment of the number of seeds per unit weight.

The invention has been described in detail with particular reference to certain preferred embodiments thereof, but it will be understood that variations and modifications can be effected within the spirit and scope of the invention.

What is claimed is:

1. A method for preparing a silver halide tabular grain emulsion which comprises the steps of:

(a) preparing a batch of a nuclei emulsion in a nucleation reactor in the presence of a colloidal hydrophilic peptizing agent and then physically ripening said nuclei;

(b) growing the nuclei obtained in step (a) to obtain $M_b$ moles of tabular seeds with an average grain volume $V_s$ while keeping the ratio of initial volume of nucleation medium to final volume of growth medium of these nuclei in the nucleation reactor between 0.4 and 0.95;

(c) calculating the average grain volume $V_s$:

(d) setting and storing the $M_b$ moles of seeds obtained in step (b)

(e) taking $M_s$ moles of the batch obtained in step (b);

(f) growing the portion of Ms moles taken in a growth reactor to obtain $M_f$ moles of tabular grain emulsion with an average grain volume after growth of $V_f$; and (g) repeating steps (e) and (f) $N_b$ times to grow a total quantity of $M_b$ moles of seeds, where $M_s$ is substantially equal to $M_f \times (V_s:V_f)$, and $N_b$ is substantially equal to $M_b:M_s$.

2. The method of claim 1 wherein the ratio of initial volume of nucleation medium to final volume of in the nucleation reactor in step (b) is between 0.7 and 0.9.

3. The method of claim 1 wherein the quantity of peptizing agent used in step (a) represents between 20 and 800 g per mole of silver introduced in step (a).

4. The method of claim 1 wherein a ripening agent is used in step (a).

5. The method of claim 1 wherein after step (b), the concentration of the seed emulsion is adjusted at least once by addition of a peptizing agent of the gelatin type together with a quantity of water such that the concentration of the seed emulsion expressed in number of grains per unit weight of emulsion is maintained at a preset value.

6. The method of claim 5 wherein the concentration of the seed emulsion is adjusted to a value between $1.0\times10^{15}$ and $5\times10^{15}$ grains per kg of emulsion.

7. The method of claim 5 wherein the salts are eliminated from the emulsion after step (b).

8. The method of claim 1 wherein step (a) or step (b) is carried out by simultaneously introducing a jet of soluble silver salt and at least one jet of soluble halide into a nucleation reactor containing an aqueous solution of a peptizing agent of the gelatin type.

9. The method of claim 1 wherein at the start of step (a) the nucleation reactor contains a polyalkylene oxide block copolymer and the pAg is adjusted to a value between 9.5 and 10.0.

10. The method of claim 9 wherein the polyalkylene oxide block polymer has the structure:

LAO1-HAO1-LAO1 where

LAO1 represents a sequence of lipophilic alkylene oxide end groups, and HAO1 represents a sequence of hydrophilic alkylene oxide groups, sequence HAO1 accounting for 4 to 96% by weight of the copolymer, and the molecular weight of the copolymer is between 760 and 16,000.

11. The method of claim 1 wherein at the start of step (a) the nucleation reactor contains oxidized gelatin and step (a) is carried out at a pH between 1.5 and 2.

12. The method of claim 1 wherein step (a) is carried out with a jet of halide and a jet of silver salt each at a concentration between 3 M and 5 M, with a flow rate between 0.2 and 10 ml/minute per liter of filled reactor volume and at a temperature between 20 and 50° C.

13. The method of claim 1 wherein at step (a), the ripening of the seeds occurs at a temperature between 35 and 50° C.

14. The method claim 1 wherein in step (d), the growth is continued until tabular grains obtained having an ECD equal to or greater than 1.0 microns and an average thickness greater than 60 nm, account for at least 90% of the total surface area of the silver halide grains.

15. The method of claim 1 wherein in step (d), the growth is carried out in the presence of a polyalkylene oxide block copolymer.

16. The method of claim 1 wherein in step (d), the final volume of the tabular grains is determined according to the quantity of seeds that are introduced into the growth reactor.

17. The method of claim 1 wherein from the batch of tabular seeds generated in step (b), plural batches of emulsion grains are grown which differ from each other in average grain size, composition, or size dispersion.

* * * * *